US011680406B2

(12) United States Patent
Fitzthum

(10) Patent No.: US 11,680,406 B2
(45) Date of Patent: Jun. 20, 2023

(54) ANCHOR

(71) Applicant: DOKA GMBH, Amstetten (AT)

(72) Inventor: Michael Fitzthum, Amstetten (AT)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 17/066,369

(22) Filed: Oct. 8, 2020

(65) Prior Publication Data

US 2021/0108413 A1 Apr. 15, 2021

(30) Foreign Application Priority Data

Oct. 9, 2019 (EP) ..... 19202141

(51) Int. Cl.
*E04C 5/12* (2006.01)
*E04B 1/41* (2006.01)

(52) U.S. Cl.
CPC . *E04C 5/12* (2013.01); *E04B 1/41* (2013.01)

(58) Field of Classification Search
CPC .. F16B 13/124; F16B 13/0833; F16B 13/066; F16B 19/1081; E04B 1/41
See application file for complete search history.

(56) References Cited

U.S. PATENT DOCUMENTS 282,501 A * 8/1883 Cornell ..... F16B 13/124 411/65
674,715 A * 5/1901 Summerer ..... F16B 13/066 411/53
1,108,656 A * 8/1914 Adler ..... F16B 13/066 411/53
1,112,417 A * 9/1914 Kennedy ..... F16B 13/066 411/53
1,469,668 A * 10/1923 Karitzky ..... F16B 13/066 411/60.2
1,469,950 A * 10/1923 Ogden ..... F16B 13/066 411/53
1,549,326 A * 8/1925 Pleister ..... F16B 13/066 411/53
1,795,057 A * 3/1931 Tomkinson ..... F16B 13/066 411/53

(Continued)

FOREIGN PATENT DOCUMENTS

DE 1836787 U 8/1961
JP 2000179151 A 6/2000

(Continued)

*Primary Examiner* — Gisele D Ford
(74) *Attorney, Agent, or Firm* — McCoy Russell LLP

(57) ABSTRACT

An anchor for arrangement in a building element, in particular in a wall, in a ceiling or in a precast concrete part. The anchor includes an anchoring element for anchoring in a receiving opening of the building element comprising an undercut, a connecting element for connection to a supporting element, in particular to a platform for formwork, or to a support arm for a protective shield, or to a lifting element for lifting the building element. In some aspects, the anchoring element is movable between an anchoring position for anchoring in the receiving opening and a release position for removal from the building element. The anchor may additionally include a securing element which blocks the movement of the anchoring element between the anchoring position and the release position in a first position and releases the anchoring element in a second position.

17 Claims, 5 Drawing Sheets

(56) References Cited

U.S. PATENT DOCUMENTS 2,379,786 A * 7/1945 Bugg ..... F16B 39/284 411/80.6
2,640,618 A * 6/1953 Hale, Jr. ..... F16B 5/04 403/243
2,871,749 A * 2/1959 Kalb ..... F16B 13/124 411/935
4,056,037 A * 11/1977 McIntyre ..... F16B 13/066 411/60.2
4,391,559 A * 7/1983 Mizusawa ..... F16B 19/1081 411/41
4,478,542 A * 10/1984 Whelan, Jr. ..... F16B 33/002 411/26
4,564,324 A * 1/1986 Leibhard ..... B22F 5/00 411/3
5,065,490 A * 11/1991 Wivagg ..... G21C 11/08 29/402.09
5,156,507 A * 10/1992 Underbrink ..... F16B 13/066 411/80
5,356,252 A * 10/1994 Whistler, III ..... F16B 13/06 411/57.1
5,816,759 A * 10/1998 Ernst ..... F16B 13/066 411/24
6,428,256 B2 * 8/2002 Wieser ..... F16B 13/124 411/60.3
6,896,460 B2 * 5/2005 Enomoto ..... F16B 19/1081 411/41
7,993,085 B2 * 8/2011 McClure ..... F16B 19/1081 411/80.6
8,430,614 B2 * 4/2013 Ito ..... F16B 13/066 411/72
8,434,980 B2 * 5/2013 Hsu ..... F16B 13/0858 411/72
8,517,650 B2 * 8/2013 Niklewicz ..... F16B 13/124 411/57.1
8,931,988 B2 * 1/2015 Shimizu ..... F16B 13/124 411/57.1
9,291,188 B2 * 3/2016 English ..... F16B 13/0808
9,644,658 B2 * 5/2017 Daykin ..... F16B 13/0833
9,709,085 B2 * 7/2017 McClure ..... F16B 19/109
10,047,777 B2 * 8/2018 Andou ..... E21D 21/0026
10,465,734 B2 * 11/2019 McClure ..... F16B 37/043
10,589,362 B2 * 3/2020 Shimmura ..... E04B 1/5825
10,589,835 B2 * 3/2020 Mills ..... F16B 19/1081
10,641,306 B2 * 5/2020 Huang ..... F16B 13/124
10,670,059 B2 * 6/2020 Jackson, Jr. ..... F16B 21/076
10,920,812 B2 * 2/2021 Avetisian ..... F16B 5/0642
10,995,487 B2 * 5/2021 Cabaj ..... E04B 1/4121
11,092,179 B2 * 8/2021 Banno ..... F16B 19/1081
11,193,517 B2 * 12/2021 McClure ..... F16B 19/109
11,204,053 B2 * 12/2021 Walz ..... F16B 12/20
11,225,992 B2 * 1/2022 Bansal ..... F16B 11/006
2002/0194718 A1 * 12/2002 Yekutiely ..... F16B 13/0858 29/33 K
2004/0253075 A1 * 12/2004 Liebig ..... F16B 13/066 411/57.1
2005/0169726 A1 * 8/2005 McClure ..... F16B 19/1081 411/55
2008/0056840 A1 * 3/2008 Hitchcock ..... F16B 19/1081 411/45
2008/0056841 A1 * 3/2008 Zimmerer ..... F16B 25/0031 411/55
2009/0142156 A1 * 6/2009 Pisoni ..... F16B 13/066 411/55
2010/0086376 A1 * 4/2010 McClure ..... F16B 19/1081 411/71
2010/0129172 A1 * 5/2010 Gottlich ..... F16B 13/063 411/63
2010/0212250 A1 * 8/2010 McSherry ..... F16B 13/066 52/704
2011/0008124 A1 * 1/2011 Niklewicz ..... F16B 13/0833 411/80.6
2011/0038683 A1 * 2/2011 Ito ..... F16B 13/066 411/16
2012/0230796 A1 * 9/2012 McClure ..... F16B 19/109 411/80.1
2016/0084287 A1 * 3/2016 Daykin ..... F16B 13/0808 411/174
2017/0248163 A1 * 8/2017 McClure ..... F16B 33/002
2017/0291227 A1 * 10/2017 Shimmura ..... E04B 1/5825
2018/0258970 A1 * 9/2018 Avetisian ..... F16B 13/045
2019/0093337 A1 * 3/2019 Cabaj ..... F16B 13/06
2021/0324893 A1 * 10/2021 Dohi ..... F16B 13/066

FOREIGN PATENT DOCUMENTS

JP 3145993 U 10/2008
WO 2008019408 A1 2/2008

* cited by examiner

ANCHOR

CROSS REFERENCE TO RELATED APPLICATION

The present application claims priority to European Patent Application No. 19202141.8 filed on Oct. 9, 2019. The entire contents of the above-listed application is hereby incorporated by reference for all purposes.

TECHNICAL FIELD

The disclosure relates to an anchor for arrangement in a building element, in particular a wall, a ceiling, or a precast concrete part.

BACKGROUND AND SUMMARY

Anchors are known for example from WO2008/019408 A1. In this prior art, a building structure is erected with the aid of climbing formwork. The climbing formwork comprises climbing units, which are held to already completed wall sections by means of climbing rails. The climbing rails are supported by climbing shoes, which are held to the wall with the aid of the anchors. The anchors include conical sections adjacent to the wall surface, to which conical sections the climbing shoes can be screwed.

A drawback, however, is that a part of the anchor, in particular the so-called stop anchor, is introduced into the building structure as a foreign body, which remains in the building structure even after completion. Furthermore, the material outlay is high.

The problem of the invention consists in mitigating or removing at least individual drawbacks of the prior art. In particular, the invention sets itself the task of enabling a straightforward retrieval at least of parts of the anchor for further uses.

The disclosure comprises an anchor for arrangement in a building element, in particular a wall, a ceiling, or a precast concrete part. The anchor includes an anchoring element for anchoring in a receiving opening of the building element comprising an undercut and a connecting element for connection to a supporting element or to a support arm for a protective shield, or to a lifting element for lifting the building element. In some aspects, the anchor may be part of an anchoring device including a tool connected to the securing element of the anchor.

According to the disclosure, the anchoring element is movable between an anchoring position for anchoring in the receiving opening and a release position for removal from the building element, wherein a securing element which can be moved between a first position and a second position is provided, which is set up to block the movement of the anchoring element between the anchoring position and the release position in the first position and to release the anchoring element in the second position.

In the second position of the securing element (unsecured position), the movement of the anchoring element is released, so that the anchoring element may be moved reversibly and without permanent deformation from the anchoring position into the release position (and vice versa). In the first position of the securing element, the movement of the anchoring element is blocked, so that the anchoring element is reliably anchored in the undercut of the receiving opening. In the first position, the securing element may abut against the anchoring element in such a way that a movement of the anchoring element in the direction of the release position is prevented. The removal of the anchoring element from the receiving opening is provided by moving the securing element from the first position into the second position. In the second position of the securing element, the anchoring element can be transferred from the anchoring position, in which the anchoring element engages in the undercut of the receiving opening in the building element, into the release position, in which the anchoring element is completely moved out of the undercut of the receiving opening. The securing element is movable between the first and the second position, preferably in an axial direction, i.e. in the direction of the central longitudinal axis of the elongated anchor. In the release position, the anchoring element can be removed. In some aspects, it may be removed together with the connecting element and the securing element, from the receiving opening of the building element.

In one embodiment, the securing element is constituted as a pull-out element for pulling the anchor out of the receiving opening, so that, by applying a pulling force to the securing element, in particular by means of a tool, not only is the release of the anchoring element brought about, but in addition the anchor can be pulled out of the receiving opening. In this embodiment, the anchoring element can be moved passively into the release position by contact with the (concrete) body of the building element surrounding the anchor, when the anchor is pulled out of the receiving opening by means of the securing element.

According to a further embodiment, an actuating element is provided, which is set up to transfer the anchoring element between the anchoring position and the release position. When the actuating element is moved from a first into a second position, a force is imparted to the anchoring element, in such a way that the anchoring element is moved, preferably inwards, from the anchoring position into the release position. In this embodiment, the anchoring element is moved actively, via the actuating element, into the release position, wherein the securing element is arranged in the second position.

In some embodiments, the securing element and the actuating element are implemented by a securing and actuating element, which brings about the release of the anchoring element and the active movement of the anchoring element into the release position. In an alternative embodiment, however, the securing element and the actuating element can be constituted by different components.

For the actuation of the securing and actuating element, use may be made of a tool, which is detachably connected to the anchor solely for the retrieval of the anchoring element and, where applicable, also the connecting element. If the supporting element is fastened to the anchor during use, the tool is not connected to the anchor. According to one embodiment, the anchor may be removed after use at least partially from the building structure. Advantageously, no unnecessary foreign body thus remains in the building structure. The risk of corrosion existing in the case of conventional stop anchors can thus be avoided. In addition, it is advantageous that the anchor can be reused, so that a cost saving can be achieved.

The anchoring element, the connecting element, and the securing element, and in some aspects also the actuating element, may be captively connected to one another.

The anchor according to the disclosure can be used for various purposes in the erection of building structures.

In a first application, the anchor holds a support arm, which may be arranged in a horizontal position on a (concrete) ceiling. A climbing profile may be fitted to the support arm, which in particular supports a protective shield for shielding an outer edge of the ceiling during the erection of a building structure.

In a second application, the anchor supports a platform with formwork, in particular with wall formwork, for casting a (concrete) wall.

In a third application, the anchor is arranged in a precast concrete part, wherein a lifting element, for example a crane, is fitted to the anchor for lifting the precast concrete part.

In order to enable stable anchoring in the anchoring position and easy removal in the release position, the anchoring element, in particular at its rear end, comprises a splaying part in one embodiment, which, in the anchoring position, projects radially outwards at its rear end region relative to the outer side of the connecting element and, in the release position, is arranged at its rear end region in the radial direction as far or farther inwards than the outer side of the connecting element. In the anchoring position, the splaying part thus brings about a form-fit connection between the anchoring element and the receiving opening of the building element. By transferring the anchoring element into the release position, such as by means of the actuating element or passively by means of the surrounding (concrete) body of the building element, the splaying part is displaced so far inwards that the splaying part does not project beyond the outer side of the connecting element on the side of the anchoring element. In the release position, the anchoring element, alone or together with the connecting element and the securing element, and in some aspects also with the actuating element, can be pulled out of the receiving opening in the axial direction. Re-use of the anchoring element, in particular also of the connecting element and the securing element, and in some embodiments also the actuating element, is thus enabled in a particularly straightforward manner.

In order to anchor the anchor as well as possible in the building element, it is advantageous if the anchoring element comprises a plurality, in particular three, splaying parts, which may be arranged at regular angular intervals in the circumferential direction. In one embodiment, precisely three identical splaying parts are provided, which are distributed each offset from one another by 120 degrees in the circumferential direction.

For the purposes of this disclosure, the terms "axial", "radial" and "tangential" etc. relate to the central longitudinal axis of the anchor. When the anchor is inserted during the erection of a building structure, the location and directional data, such as "vertical", "horizontal" etc., relate to a building structure with horizontal ceilings and vertical walls. In the case of a differing building geometry, the location and directional data are to be rendered accordingly.

In order to enable the movement of the splaying parts, intermediate spaces between the splaying parts may be constituted in the anchoring position, which in the release position are at least partially, in particular completely closed. The intermediate spaces can thus be used to release the movement of the splaying parts from the outer anchoring position into the inner release position, i.e. inwards. The splaying parts may abut against one another at the inside in the release position. With this embodiment, the intermediate spaces in the release position are completely closed.

To transfer the anchoring element from the anchoring position into the release position, the securing element and/or the actuating element, in one embodiment, may be arranged movable inside the anchoring element and/or the connecting element, in particular displaceable in the axial direction. In one embodiment, the movement of the actuating element, for example in the axial direction, may be transferred into the displacement of the anchoring element, for example radially inwards, in order to release the engagement of the anchoring element in the undercut of the receiving opening and thus to enable the removal of the anchoring element from the receiving opening.

For the release of the anchoring element, it is particularly favourable if the anchoring element can be swivelled between the anchoring position and the release position.

In some aspects, the securing element and/or the actuating element may be axially displaceable, so that the axial displacement of the securing element may be transformed into the release of the anchoring element or the axial displacement of the actuating element is transformed into the swivelling of the anchoring element.

In one embodiment, the connecting element comprises a swivelling axis running in particular essentially perpendicular to the axial direction for the swivellable arrangement of the anchoring element, wherein a plurality of swivelling axes running in particular essentially perpendicular to the axial direction may be provided for the swivellable arrangement of the splaying parts of the anchoring element.

In one embodiment, a longitudinal section of the connecting element, which can also extend essentially over the entire length of the connecting element, comprises in cross-section (viewed perpendicular to the longitudinal axis) a non-round outer contour, in particular an angular outer contour, for example a hexagonal outer contour. This embodiment has the advantage that torsional forces, i.e. forces which would bring about a rotation of the anchor about its longitudinal axis, can be reliably diverted into the building element.

An effective force transmission to the anchoring element on the one hand and a stable and secure anchoring on the other hand can be achieved if the securing and actuating element comprises an actuating head for transferring the anchoring element from the anchoring position into the release position, wherein the actuating head in the anchoring position abuts on the inside against the splaying part of the anchoring element. The actuating head in the anchoring position thus may block, from the inside, a movement, in particular swivelling, of the splaying part in particular inwards. Advantageously, a malfunction of the anchor in the anchoring position can thus be reliably prevented. By moving the actuating head away from the splaying part, in particular in the axial direction, the movement of the splaying part can be released, in order to provide for the removal of the anchoring element from the receiving opening of the building element. The actuating head may be widened compared to a longitudinal section of the securing and actuating element which may follows on at the front.

According to one embodiment, the anchoring element, in particular at the front end, comprises an actuating arm, onto which the actuating head of the securing and actuating element can be pushed, in order to move, in particular to swivel, the anchoring element into the release position. In the anchoring position, the actuating arm may abuts against the front longitudinal section of the securing and actuating element, which may comprise a smaller radial extension than the actuating head. The actuating arm of the anchoring element may comprise a run-on surface, with which a further run-on surface of the actuating head comes into contact when the securing and actuating element is actuated. The anchoring element is thus moved into the release position. The contact of the actuating head with the run-on surface of the actuating arm may bring about swivelling of the splaying part. Conversely, pushing-in of the securing and actuating element brings about an arrangement of the anchor in the anchoring position. The process is therefore reversible.

In order to make the operation of the securing element as simple as possible, it is advantageous if the securing element comprises a retaining hole, in particular with a thread, for the fitting of a tool, in particular a pulling tool. If the securing element is also constituted as an actuating element, the tool can be brought into engagement, in particular into a threaded engagement, with the retaining hole of the securing and actuating element, in order to actuate the securing and actuating element, in particular to displace it in the axial direction, and thus to release the anchoring element from the undercut of the receiving opening of the building element. By operating the tool, in particular by applying a pulling force to the tool, at least the anchoring element, and in some aspects also the connecting element and the securing and actuating element, can be removed from the receiving opening.

In order to enable the reversibly detachable fitting of the supporting element to the anchor, the connecting element preferably comprises an inner thread for a fastening screw. The connecting element preferably comprises a cylindrical section and/or a conical section, in particular at the front end. The conical shape serves to allow the part to be removed from the concrete after use.

In a one use of the anchor, the fastening screw may be connected to the connecting element, wherein the fastening screw preferably secures the securing and actuating element against a transfer of the anchoring element from the anchoring position into the release position.

In a further embodiment, a securing means, for example a spring, is provided, which secures the securing and actuating element—irrespective of the presence of the fastening screw—against a transfer of the anchoring element from the anchoring position into the release position.

In a further embodiment, the actuating element is constituted as a screw, which is displaced by rotation in the axial direction. A securing means can be dispensed with in this embodiment.

In order to enable the embedding of the anchor in concrete without impairing the function, the anchoring element can be accommodated in a sealing sleeve in one embodiment, which may comprise at least one predetermined break point. The predetermined break point can run spirally along the outer surface of the sealing sleeve and can be used for easier removal after use.

In a further embodiment, the sealing sleeve is constituted elastic and is connected captively to the anchoring element and/or to the connecting element.

A sealing sleeve may be used but is not absolutely necessary. Alternatively, the receiving opening can be produced with a feed cone, which is then removed. Furthermore, the receiving opening can be produced with the aid of a placeholder, for example made of polystyrene, which is then removed, for example chemically or thermally, before the anchor is inserted into the receiving opening. Furthermore, the receiving opening can be formed by a drill hole.

At least the following are present in a building structure according to the invention: a building element, in particular a wall or a ceiling, an anchor according to one of the previously described embodiments, wherein the anchor is arranged in the receiving opening of the building element, a supporting element, in particular a support arm, in some aspects with a climbing profile, or a platform with wall formwork.

At least the following are present in a pre-cast concrete element according to the invention:

- a precast concrete part, for example a concrete slab,
- an anchor according to one of the previously described embodiments, wherein the anchor is arranged in the receiving opening of the precast concrete part,
- a lifting element, for example a crane, which is detachably connected to the connecting element of the anchor.

In this embodiment, the anchor can be used for lifting the precast concrete element, for example between a vertical and a horizontal position. The precast concrete part can also be loaded onto a lorry.

In the method for the at least partial retrieval of the anchor from the building element, at least the following steps are carried out, preferably one after the other:

- arranging the anchor in the receiving opening of the building element,
- fitting of a tool to the securing element of the anchor,
- transferring the securing element from the first position into the second position with the aid of the tool,
- transferring the anchoring element of the anchor from the anchoring position into the release position, and
- removing the anchoring element, in particular also the connecting element and the securing element, from the building element.

Furthermore, a method for erecting a building structure can include at least the following steps, wherein further steps can of course be carried out between the stated steps:

- producing a building element, in particular a wall or a ceiling, of the building structure,
- arranging an anchor according to one of the previously described embodiments in a receiving opening of the building element,
- connecting a supporting element, such as a support arm for a climbing profile or a platform with formwork, in particular by means of a fastening screw, to the connecting element of the anchor,
- holding of the supporting element by means of the anchor,
- releasing the connection between the supporting element and the connecting element,
- wherein, when present, the fastening screw is removed from the connecting element, fitting of a tool to the securing element of the anchor,
- transferring the securing element from the first position into the second position with the aid of the tool,
- transferring the anchoring element of the anchor from the anchoring position into the release position and
- removing the anchoring element, in particular also the connecting element and the securing element, from the building element by means of the tool.

BRIEF DESCRIPTION OF THE FIGURES

The invention is explained in greater detail below with the reference to the following figures.

DETAILED DESCRIPTION

Figure 1:
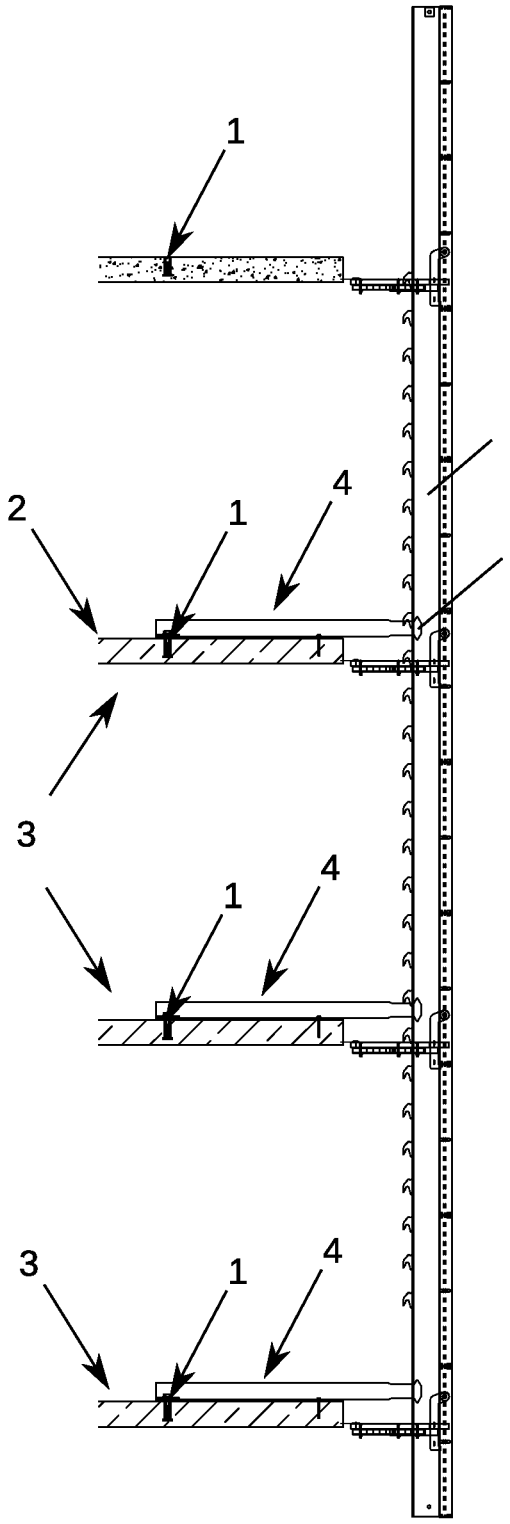
FIG. 1 shows a building structure after completion of a plurality of floors, to which horizontal support arms for a vertical climbing profile are fitted with the aid of retrievable anchors according to an embodiment of the invention.

FIG. 1 shows a first example of the application of an anchor 1 for the erection of a building structure 2, in this case a multi-story building. In the shown state, a plurality, here four, ceilings 3 of floors lying above one another have already been concreted. A plurality of horizontal support arms 4 are arranged on lower ceilings 3, each of which include a climbing shoe 5 at the front end for a vertical climbing profile 6. In the embodiment shown, a protective shield is fastened to climbing profile 6, with which the open sides of floors are secured in the construction process. Climbing profile 6 can be placed higher up with the aid of an automatic climbing device or a crane (not shown). Support arms 4 are temporally fastened to the ceilings with anchors 1. In this embodiment, anchors 1 are arranged vertically in the ceilings.

Figure 2:
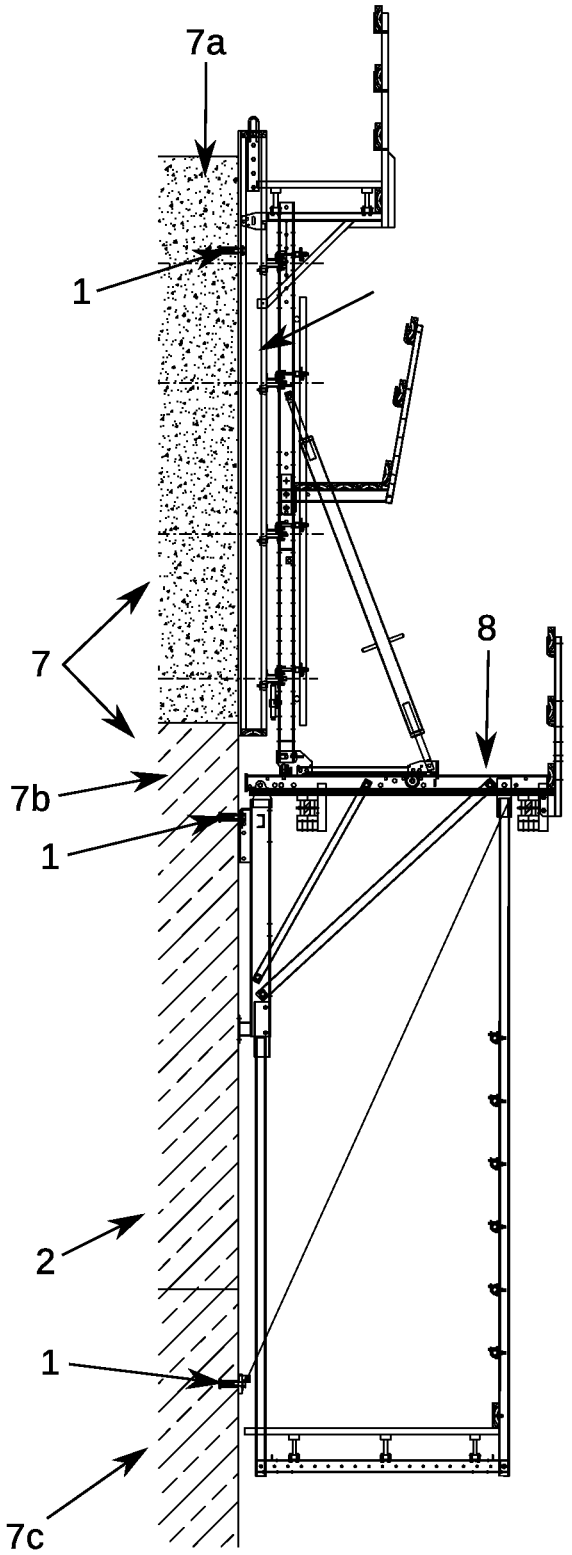
FIG. 2 shows the temporary fastening of a platform to formwork with the aid of the retrievable anchors.
Figure 3:
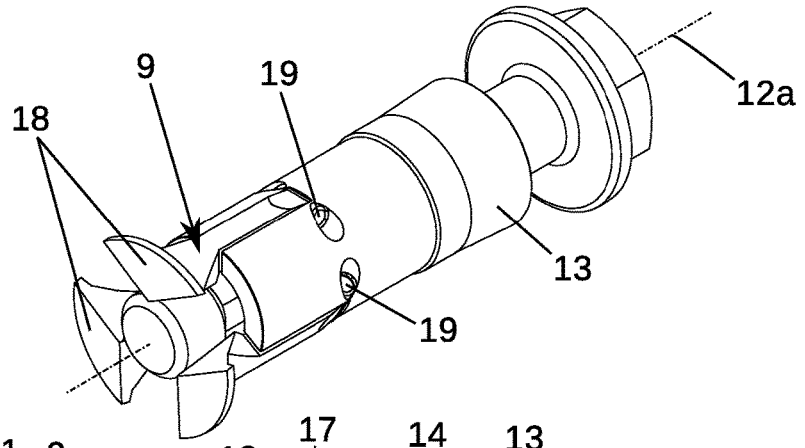
FIG. 3 shows the anchor according to FIGS. 1, 2 in an anchoring position.
Figure 4:
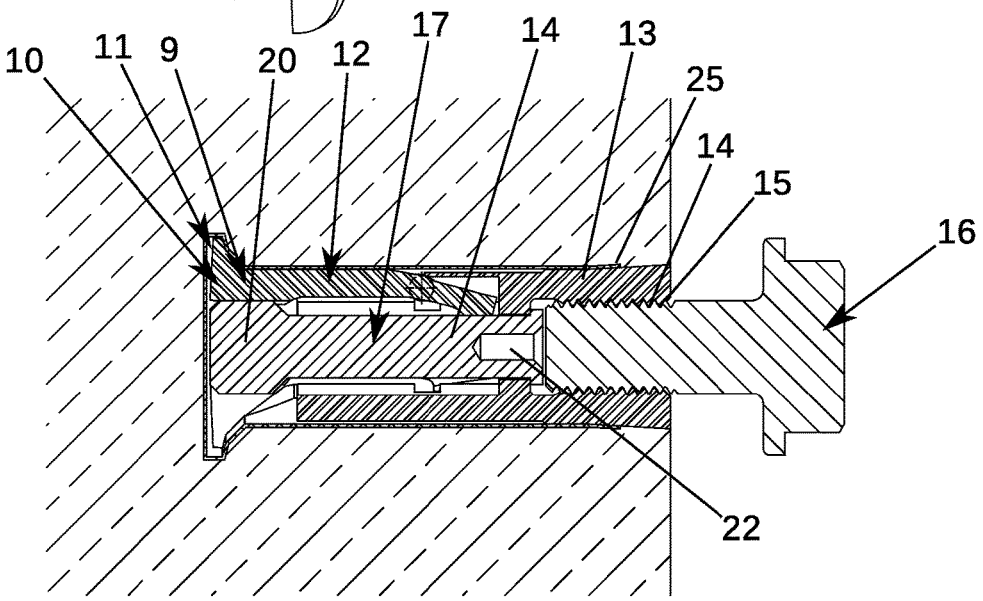
FIG. 4 shows the anchor in an installed state in the building structure in the anchoring position, wherein a fastening screw is screwed into the connecting element of the anchor.

FIG. 2 shows a second example of the application of anchor 1 in the erection of vertical walls 7 of successive floors of building structure 2. In this application, anchor 1 is embedded in concrete in the horizontal state in a first (uppermost) wall 7*a*, in order to support a platform 8 for wall formwork 9 in the next concreting step. In the shown progress of the building work, a further anchor 1, at a second wall 7*b* (lying below uppermost wall 7*a*) of a previous concreting step, supports a platform 8, on which wall formwork 9 for the concreting of uppermost wall 7*a* is arranged. In the embodiment shown, a further anchor 1 is also arranged at a third wall 7*c* below second wall 7*b*, in order to enable anchoring of platform 8. In the embodiment shown, a crane climbing system is shown. With an automatic climbing system (not shown), a climbing profile can be held via a climbing shoe by means of the lower anchor.

Anchor 1 in the various functional positions is represented in the FIGS. 3 to 9. Anchor 1 is arranged for the reversibly detachable fitting of a supporting element, for example support arm 4 (see FIG. 1) or platform 8 for wall formwork 9 (see FIG. 2), into a receiving opening 10 of a building element, in particular ceiling 3 (see FIG. 1) or wall 7 (see FIG. 2). Anchor 1 may be encased in concrete in the building element, i.e. introduced into the formwork space before the concreting. Receiving opening 10 comprises at the rear side, i.e. at the side facing away from the outer side of the building element, an undercut 11, in which an anchoring element 12 of anchor 1 can be anchored in such a way that anchor 1 is secured in the axial direction, i.e. in the direction of a central longitudinal axis 12*a* of elongated anchor 1, against removal from the building element. In FIGS. 3 to 6, anchoring element 12 is shown in each case in the anchoring position, in which anchoring element 12 engages in a form-fit manner in undercut 11 of receiving opening 10 of the building element.

At the front side (i.e. towards the outer side of the building element), anchor 1 comprises a connecting element 13, which can be connected reversibly detachable to the supporting element. In the embodiment shown, connecting element 13 comprises at the rear a cylindrical section and at the front a section widened conically towards the front. In the embodiment shown, connecting element 13 comprises an inner thread 14, which can be connected to an outer thread 15 of a fastening screw 16. According to FIG. 4, fastening screw 16 is fitted to connecting element 13. In this position, anchor 1 can carry the supporting element. In order to provide for removal of anchor 1, fastening screw 16 is unscrewed from connecting element 13 (see FIG. 5).

Figure 5:
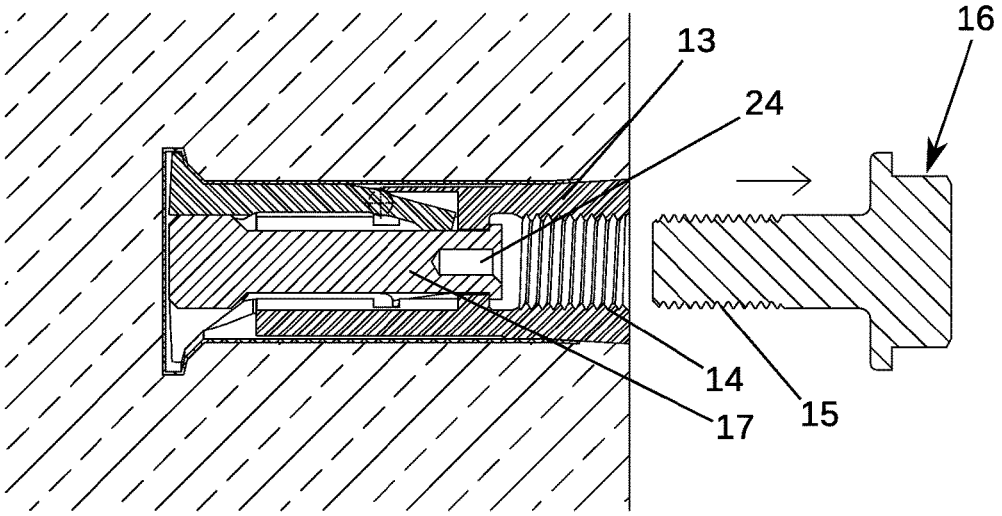
FIG. 5 shows the anchor in a position according to FIG. 4, where the fastening screw is removed from the inner thread in order to provide for the retrieval of the anchor.
Figure 6:
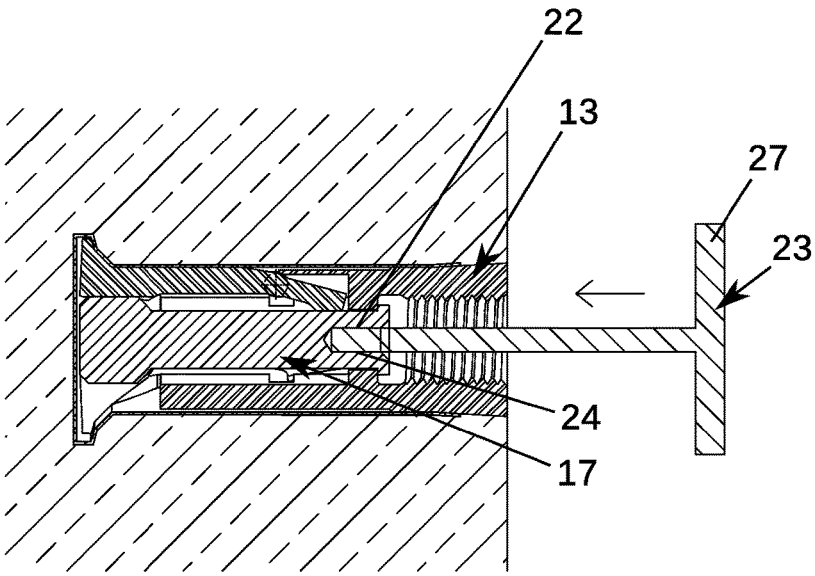
FIG. 6 shows the connection of an external tool to a securing and actuating element of the anchor.
Figure 7:
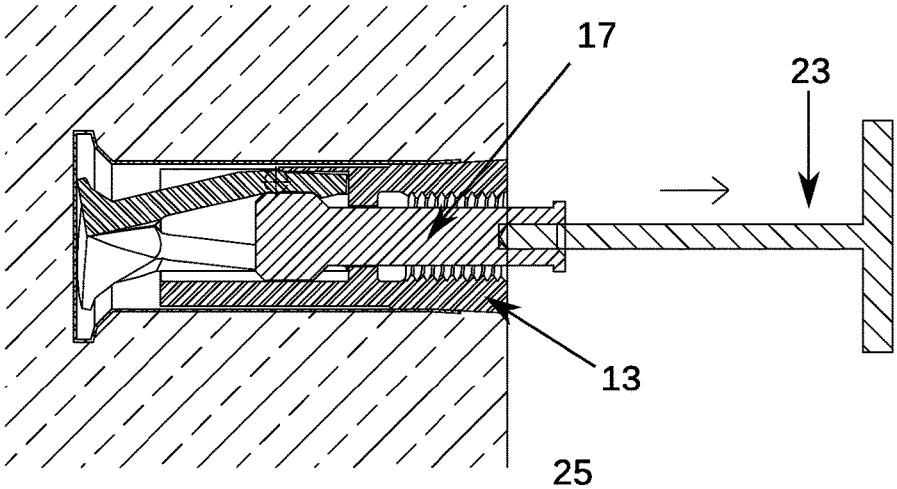
FIG. 7 shows the actuation of the tool, which brings about a drawing-together of a plurality of splaying parts by displacement of the securing and actuating element, in order to release the engagement of the anchor in the building part.
Figure 8:
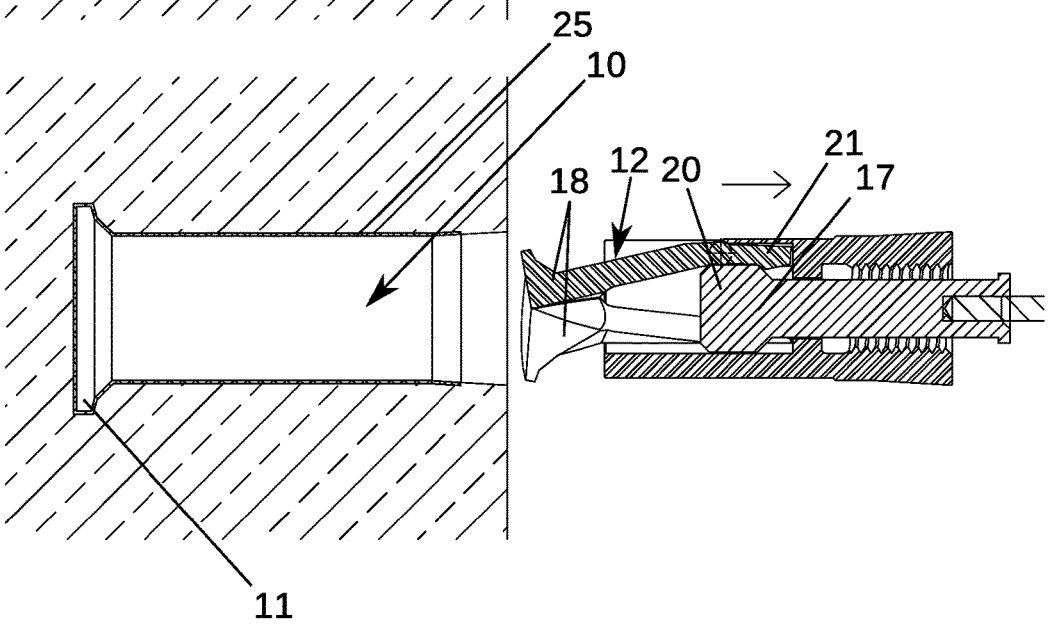
FIG. 8 shows the anchor outside the building part, wherein a sealing sleeve remains in the building part in the embodiment shown.
Figure 9:
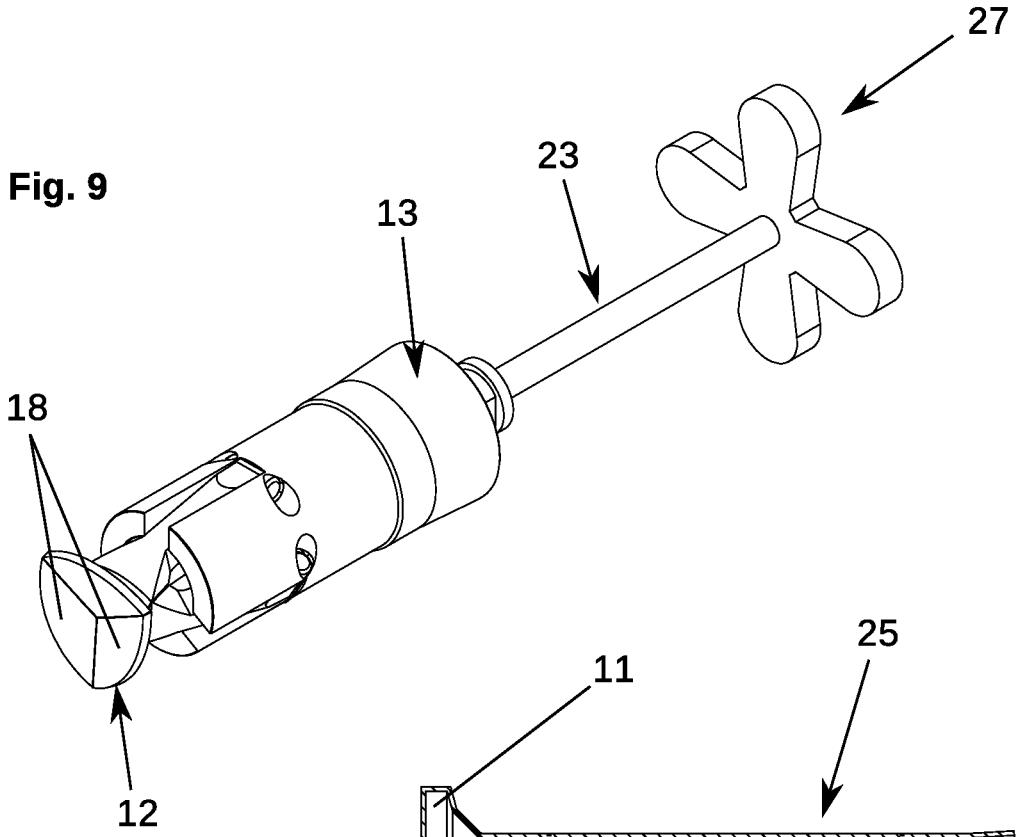
FIG. 9 shows the anchor in the release position in the connected state to the tool.
Figure 10:
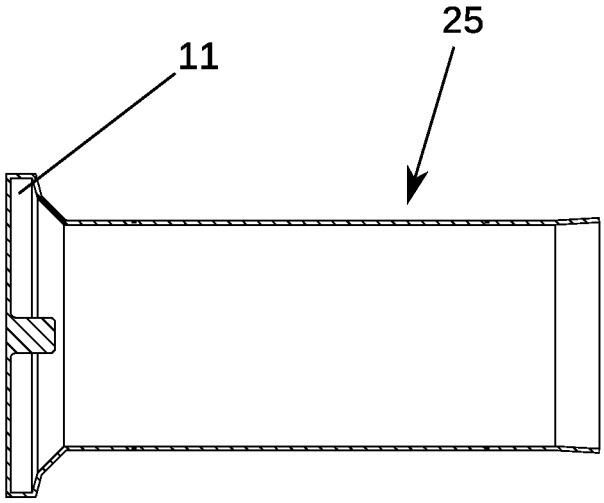
FIG. 10 and FIG. 11 show a sealing sleeve of the anchor.
Figure 11:
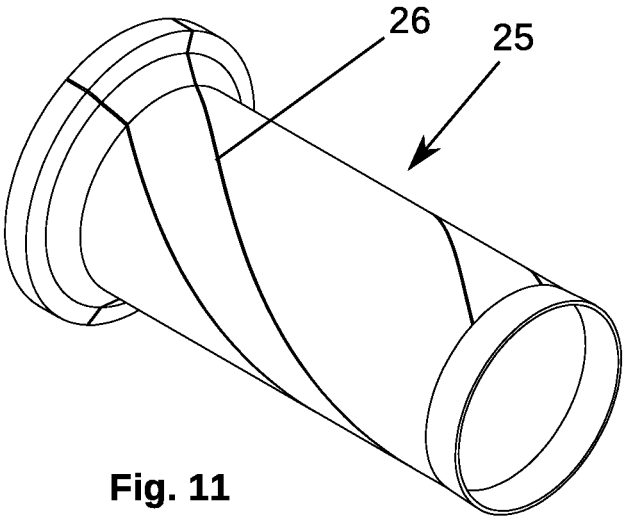

As can be seen from the drawing, an anchor 1 also comprises a securing and actuating element 17, with which anchoring element 12 can be transferred from the outer anchoring position shown in FIGS. 3 to 6 into an inner release position shown in FIGS. 7 to 9, in order to enable retrieval at least of anchoring element 12 and connecting element 13. Anchoring element 12, connecting element 13 and securing and actuating element 17 are preferably made of metal.

Anchoring element 12 comprises at least one splaying part 18 at its rear end, in the region of undercut 11 of receiving opening 10. In the outer anchoring position, splaying part 18 projects outwards at its rear end region in the radial direction (perpendicular to longitudinal axis 12) beyond the outer side of connecting element 13, in order to create a form-fit connection between anchoring element 12 and receiving opening 10. In the inner release position, splaying part 18, viewed in the radial direction, is arranged at its rear end region as far or farther inwards than the outer side of connecting element 13, in order to enable pulling-out in the axial direction.

In the embodiment shown, anchoring element 12 comprises a plurality, in this case three, of identical splaying parts 18, which are arranged at regular angular intervals in the circumferential direction (i.e. tangentially relative to the cylindrical cross-section of connecting element 13). In the outer anchoring position, separated intermediate spaces are formed between splaying parts 18, which are at least partially closed, in the embodiment shown completely closed, in the release position.

Securing and actuating element 17 is arranged movable in the interior of anchoring element 13, in the embodiment shown in the axial direction. The displacement of securing and actuating element 17 brings about swivelling of anchoring element 12 between the anchoring position and the release position. In the embodiment shown, splaying parts 18 are mounted on connecting element 13 by means of swivelling pins 19. To transfer anchoring element 12 from the outer anchoring position into the inner release position, securing and actuating element 17 comprises an actuating head 20 at the rear end. In the outer anchoring position, actuating head 20 abuts on the inside against splaying parts 18 of anchoring element 12. In the embodiment shown, splaying parts 18 each comprise at their front ends an actuating arm 21, onto which actuating head 20 of securing and actuating element 17 can be pushed, in such a way that splaying parts 18 are swivelled into the inner release position. In addition, securing and actuating element 17 comprises a retaining hole 22 at the front end, to which a tool 23 can be fitted reversibly detachable, in order to remove anchor 1 from the building element. In the embodiment shown, retaining hole 22 comprises a thread 24, into which tool 23 can be screwed.

In the embodiment shown, a sealing sleeve 25 formed corresponding to receiving opening 10 is also provided, which surrounds anchor 1 in receiving opening 10 of the building element at least to an extent such that the encasement of anchor 1 in concrete and does not impair the functioning of anchor 1. Sealing sleeve 25 can have predetermined breaking points 26, in order to facilitate subsequent removal of sealing sleeve 25 from the building element.

The operational sequence in the retrieval of parts of anchor 1 emerges from FIGS. 4 to 8.

In the first place, anchor 1 is arranged in receiving opening 10 of the building element. Fastening screw 16 is connected to connecting element 13 in such a way that fastening screw 16 secures securing and actuating element 17 against a transfer of anchoring element 12 from the outer anchoring position into the inner release position (see FIG. 4).

Fastening screw 16 is then unscrewed from connecting element 13 (see FIG. 5).

Tool 23 is then fitted to securing and actuating element 17 of anchor 1 (see FIG. 6). Tool 23 comprises a handle 27, with which the screwing-in of the tool into retaining hole 22 of securing and actuating element 17 and the removal of the anchor is facilitated.

By applying a pulling force to tool 23, anchoring element 12 of anchor 1 can then be transferred from the outer anchoring position into the inner release position (see FIG. 7).

By continued pulling on tool 23, anchoring element 12 is removed together with connecting element 13 from receiving opening 10 of the building element (see FIG. 8).

Figure 12:
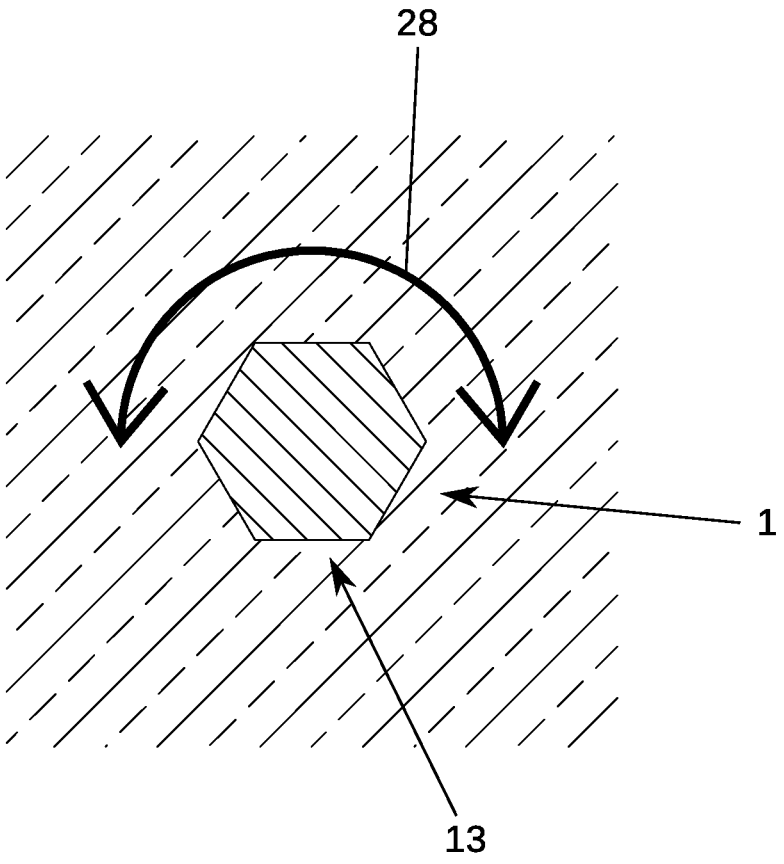
FIG. 12 shows a cross-section through an alternative anchor, where the connecting element comprises a hexagonal outer contour.

FIG. 12 represents diagrammatically a cross-section through anchor 1 in the region of connecting element 13, which in the embodiment shown comprises an angular, here a hexagonal, outer contour, in order to enable a diversion of torsional forces, see double arrow 28. For the sake of greater clarity, the inner structure of connecting element 13 is not represented.

The invention claimed is:

1. An anchor for arrangement in a building element, comprising:

an anchoring element for anchoring in a receiving opening of the building element comprising an undercut, the anchoring element comprising a splaying part, a connecting element for connection to a supporting element, wherein the anchoring element is movable between an anchoring position for anchoring in the receiving opening and a release position for removal from the building element, wherein the splaying part of the anchoring element, in the anchoring position, projects outward at a rear end region in a radial direction beyond an outer side of the connecting element and, in the release position, is arranged at the rear end region in the radial direction inside the outer side of the connecting element, wherein a securing element which can be moved between a first position and a second position is provided, which blocks movement of the anchoring element between the anchoring position and the release position in the first position and releases the anchoring element in the second position, further comprising a securing and actuating element for transferring the anchoring element between the anchoring position and the release position, wherein the securing and actuating element is arranged movable in an interior of the anchoring element and/or the connecting element, wherein the securing and actuating element comprises an actuating head for transferring the anchoring element from the anchoring position into the release position, and wherein a front end of the anchoring element opposite the rear end comprises an actuating arm, onto which the actuating head of the securing and actuating element is pushed, in order to move the anchoring element into the release position.

2. The anchor according to claim 1, wherein the anchoring element comprises a plurality of splaying parts.

3. The anchor according to claim 1, wherein the securing and actuating element is arranged displaceable in an axial direction, in the interior of the anchoring element and/or the connecting element.

4. The anchor according to claim 1, wherein the anchoring element can be swivelled between the anchoring position and the release position.

5. The anchor according to claim 3, wherein the actuating head in the anchoring position abuts on an inside against the splaying part of the anchoring element.

6. The anchor according to claim 1, wherein the securing element comprises a retaining hole with a thread, for fitting of a tool.

7. The anchor according to claim 1, wherein the connecting element comprises an inner thread for a fastening screw.

8. The anchor according to claim 7, wherein the fastening screw is connected to the connecting element, and wherein the fastening screw secures the securing and actuating element against a transfer of the anchoring element from the anchoring position into the release position.

9. The anchor according to claim 1, wherein the anchoring element is accommodated in a sealing sleeve, which comprises at least one predetermined break point.

10. The anchor of claim 1, wherein the supporting element is a platform for a form work, a support arm for a protective shield, or a lifting element for lifting the building element.

11. The anchor according to claim 2, wherein the plurality of splaying parts is three splay elements.

12. The anchor according to claim 2, wherein the plurality of splaying parts are arranged at regular angular intervals in a circumferential direction.

13. The anchor of claim 6, wherein the tool is a pulling tool.

14. The anchor of claim 9, wherein the connecting element is also accommodated in a sealing sleeve comprising at least one predetermined break point.

15. An anchoring device, comprising:

an anchor for arrangement in a building element, comprising:

an anchoring element for anchoring in a receiving opening of the building element comprising an undercut, the anchoring element comprising a splaying part, a connecting element for connection to a supporting element or to a support arm for a protective shield, or to a lifting element for lifting the building element, wherein the anchoring element is movable between an anchoring position for anchoring in the receiving opening and a release position for removal from the building element, wherein the splaying part of the anchoring element, in the anchoring position, projects outward at a rear end region in a radial direction beyond an outer side of the connecting element and, in the release position, is arranged at the rear end region in the radial direction inside the outer side of the connecting element, wherein a securing element which can be moved between a first position and a second position is provided, which blocks movement of the anchoring element between the anchoring position and the release position in the first position and releases the anchoring element in the second position, further comprising a securing and actuating element for transferring the anchoring element between the anchoring position and the release position, wherein the securing and actuating element is arranged movable in an interior of the anchoring element and/or the connecting element, wherein the securing and actuating element comprises an actuating head for transferring the anchoring element from the anchoring position into the release position, wherein a front end of the anchoring element opposite the rear end comprises an actuating arm, onto which the actuating head of the securing and actuating element is pushed, in order to move the anchoring element into the release position, and a tool connected to the securing element of the anchor.

16. A building element, with an anchor arranged in a receiving opening of the building element, wherein the anchor comprises:

an anchoring element for anchoring in the receiving opening of the building element comprising an undercut, the anchoring element comprising a splaying part, a connecting element for connection to a supporting element or to a support arm for a protective shield, or to a lifting element for lifting the building element, wherein the anchoring element is movable between an anchoring position for anchoring in the receiving opening and a release position for removal from the building element, wherein the splaying part of the anchoring element, in the anchoring position, projects outward at a rear end region in a radial direction beyond an outer side of the connecting element and, in the release position, is arranged at the rear end region in the radial direction inside the outer side of the connecting element, wherein a securing element which can be moved between a first position and a second position is provided, which blocks movement of the anchoring element between the anchoring position and the release position in the first position and releases the anchoring element in the second position, further comprising a securing and actuating element for transferring the anchoring element between the anchoring position and the release position, wherein the securing and actuating element is arranged movable in an interior of the anchoring element and/or the connecting element, wherein the securing and actuating element comprises an actuating head for transferring the anchoring element from the anchoring position into the release position, wherein a front end of the anchoring element opposite the rear end comprises an actuating arm, onto which the actuating head of the securing and actuating element is pushed, in order to move the anchoring element into the release position, and wherein the building element is a wall, ceiling, or precast concrete part.

17. A method for at least partial retrieval of an anchor from a building element, comprising the steps of:

arranging an anchor in a receiving opening of the building element, wherein the anchor comprises:

an anchoring element for anchoring in a receiving opening of the building element comprising an undercut, the anchoring element comprising a splaying part, a connecting element for connection to a supporting element or to a support arm for a protective shield, or to a lifting element for lifting the building element, wherein the anchoring element is movable between an anchoring position for anchoring in the receiving opening and a release position for removal from the building element, wherein the splaying part of the anchoring element, in the anchoring position, projects outward at a rear end region in a radial direction beyond an outer side of the connecting element and, in the release position, is arranged at the rear end region in the radial direction inside the outer side of the connecting element, wherein a securing element which can be moved between a first position and a second position is provided, which blocks movement of the anchoring element between the anchoring position and the release position in the first position and releases the anchoring element in the second position, further comprising a securing and actuating element for transferring the anchoring element between the anchoring position and the release position, wherein the securing and actuating element is arranged movable in an interior of the anchoring element and/or the connecting element, wherein the securing and actuating element comprises an actuating head for transferring the anchoring element from the anchoring position into the release position, wherein a front end of the anchoring element opposite the rear end comprises an actuating arm, onto which the actuating head of the securing and actuating element is pushed, in order to move the anchoring element into the release position, fitting a tool to the securing element of the anchor, transferring the securing element from the first position into the second position with aid of the tool, transferring the anchoring element of the anchor from the anchoring position into the release position, and removing the anchoring element, the connecting element, and the securing element, from the building element.

* * * * *